US011884604B2

(12) United States Patent
van Driel et al.

(10) Patent No.: US 11,884,604 B2
(45) Date of Patent: Jan. 30, 2024

(54) PROPELLANT CHARGE

(71) Applicant: NEDERLANDSE ORGANISATIE VOOR TOEGEPAST-NATUURWETENSCHAPPELIJK ONDERZOEK TNO, 's-Gravenhage (NL)

(72) Inventors: Christoffel Adrianus van Driel, 's-Gravenhage (NL); Dinesh Ravindre Ramlal, 's-Gravenhage (NL); Martijn Zebregs, 's-Gravenhage (NL); Michiel Hannes Straathof, 's-Gravenhage (NL)

(73) Assignee: NEDERLANDSE ORGANISATIE VOOR TOEGPAST-NATUURWETENSCHAPPELIJK ONDERZOEK TNO, 's-Gravenhage (NL)

( * ) Notice: Subject to any disclaimer, the term of this patent is extended or adjusted under 35 U.S.C. 154(b) by 1424 days.

(21) Appl. No.: 15/758,808

(22) PCT Filed: Sep. 12, 2016

(86) PCT No.: PCT/NL2016/050630
§ 371 (c)(1),
(2) Date: Mar. 9, 2018

(87) PCT Pub. No.: WO2017/043975
PCT Pub. Date: Mar. 16, 2017

(65) Prior Publication Data

US 2020/0231517 A1 Jul. 23, 2020

(30) Foreign Application Priority Data

Sep. 10, 2015 (EP) ..... 15075042

(51) Int. Cl.
*C06B 45/00* (2006.01)
*C06B 45/12* (2006.01)

(52) U.S. Cl.
CPC ..... *C06B 45/00* (2013.01); *C06B 45/12* (2013.01)

(58) Field of Classification Search
None
See application file for complete search history.

(56) References Cited

U.S. PATENT DOCUMENTS 3,754,060 A 8/1973 Gawlick
3,938,440 A 2/1976 Dooley et al.
(Continued)

FOREIGN PATENT DOCUMENTS

EP 0304100 A1 2/1989
WO WO-9714169 A1 * 4/1997 ..... C06B 45/00
WO 2011153655 A2 12/2011

OTHER PUBLICATIONS

International Search Report and Written Opinion for International Application No. PCT/NL2016/050630 (dated Nov. 11, 2016) (7 Pages).

*Primary Examiner* — Aileen B Felton
(74) *Attorney, Agent, or Firm* — LUCAS & MERCANTI, LLP

(57) ABSTRACT

The invention is in the field of propellants. In particular the invention is directed to a propellant for ammunition, such as medium and large caliber gun ammunition, having improved performance. In accordance with the present invention a propellant charge comprises one or more longitudinally extending, progressive-externally burning grains having a number of perforations passing through the grains in the length direction and having a cross-sectional shape (perpendicular to the grain's length direction) that is elongated.

10 Claims, 4 Drawing Sheets

(56) References Cited

U.S. PATENT DOCUMENTS

| | | | | |
|---|---|---|---|---|
| 4,094,248 | A | 6/1978 | Jacobson | |
| 4,386,569 | A * | 6/1983 | Deas | C06B 45/00 102/292 |
| 4,911,077 | A * | 3/1990 | Johansson | F42B 5/16 102/292 |
| 2011/0174184 | A1 * | 7/2011 | Stark | F41A 19/58 102/202.5 |

* cited by examiner

PROPELLANT CHARGE

CROSS-REFERENCE TO RELATED APPLICATIONS

This application is a 371 of PCT/NL2016/050630, filed Sep. 12, 2016 which claims the benefit of European Patent Application No. 15075042.0, filed Sep. 10, 2015.

FIELD OF THE INVENTION

The invention is in the field of propellants. In particular the invention is directed to a propellant for ammunition, such as medium and large caliber gun ammunition, having improved performance.

BACKGROUND OF THE INVENTION

Gun propellants are designed to propel projectiles from a gun at a high velocity, while the pressures developed in the gun barrel must at all times remain below the gun's critical level in order not to damage it. After ignition of the propellant charge, the pressure rises and the projectile starts to move through the gun barrel. As a result of the increasing projectile velocity, the volume of the combustion chamber increases with an increasing rate. This allows for a progressively increasing combustion rate of the propellant charge in order to obtain maximum performance, which can be obtained by different means, in particular by chemical or physical means. In the latter case the propellant grains have elongated shapes (mostly cylindrical or hexagonal) and a number of perforations, which run in the length direction. These perforations are applied such that the exposed surface areas of these perforations increase during burning while the outer grain surface area decreases, which can result in a net increase of the total surface area. This contributes to the required progressively increasing combustion rate.

Solid propellants are normally manufactured in the form grains. These grains may for instance have the form of flakes, balls, sheets, cords, perforated cylindrical or hexagonal grains These various shapes are used to obtain different types of burning action. In large guns (typically 40 mm or more), a cylindrical or hexagonal grain with seven or nineteen perforations is often used, while 20 mm guns typically use grains with a single perforation. Smaller calibers, including small arms, use flake or ball grains. The cylindrical grains are made in various diameters and lengths, but size is normally stated in web thickness, which is the distance between two perforations or the distance from a perforation to the outer surface of the grain.

These common propellant grain geometries are also shown in FIG. 1. Depending on the geometry of the grain, a degressive (viz. showing a decreasing propellant grain surface area as combustion proceeds) or progressive (viz. showing an increasing propellant grain surface area as combustion proceeds) combustion is obtained.

In addition to these common shapes, other shapes have been proposed. WO-A-2011/153655, incorporated herein in its entirety, for instance describes a cubic grain shape with four perforations. This grain geometry is said to yield higher progressivity than standard non-perforated and single-perforated grain geometries due to the presence of four perforations and increased gravimetric density which is claimed to result in significant performance gains (typically 5-8% higher muzzle velocity, which corresponds to 10-15% higher kinetic energy).

U.S. Pat. No. 3,754,060, incorporated herein in its entirety, describes angular shaped powder particles for propellant charges which have projecting spikes that interlock with each other. These particles can be pressed together to form a shaped article, without requiring a solvent or binder.

U.S. Pat. No. 4,386,569, incorporated herein in its entirety, describes a propellant grain comprising a cylinder of hexagonal cross-section that is provided with a plurality of perforations, preferably 37, passing therethrough.

SUMMARY OF THE INVENTION

The present inventors surprisingly found that progressively burning grains that are at least approximately oblate spheroidal particles provide for excellent properties. Therefore, in a first aspect the present invention is directed to a propellant charge comprising one or more longitudinally extending, progressive-externally burning grains having a cross-sectional shape, perpendicular to the grain's length direction, that is elongated.

DETAILED DESCRIPTION OF THE INVENTION

Figure 1:
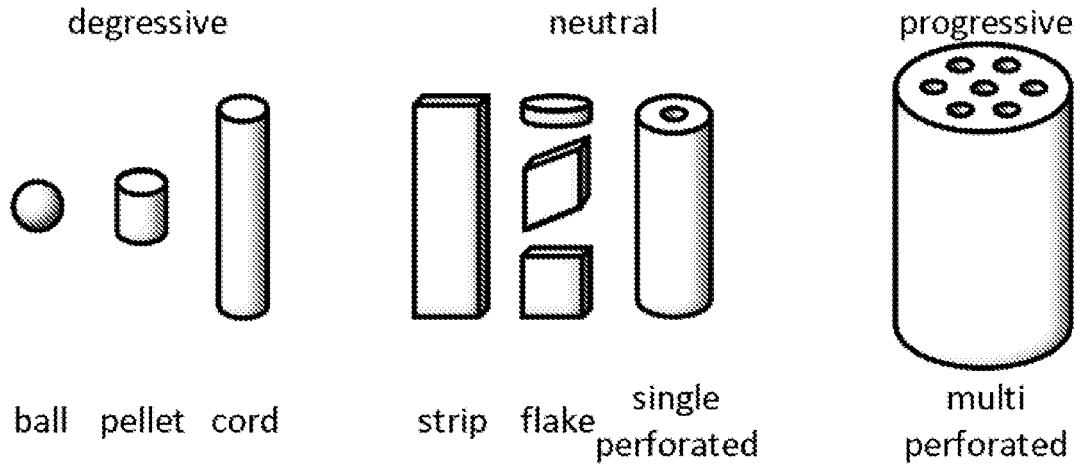
FIG. 1 is a schematic illustration of common propellant grain geometries.

The cross-sectional shape (perpendicular to the grain's length direction) is non-circular but elongated (or oblong). This is for instance the case when this cross-sectional shape is line-symmetric in at most two different lines.

When considering the quality of firearm ammunition, projectile velocity is an important parameter. The projectile velocity is determined by the properties of the propellant. The present inventors realized that in conventional ammunition the packing density of the propellant particles is limited considerably by the shape of the particles. Empty space between particles can not contribute to the propelling power. The packing density (bulk density) of conventional propellants varies normally from 0.8 to 1.0 kg/dm$^3$. This corresponds to a packing density of 52-65 vol. % (based on a typical density of the propellant material of 1.54 kg/m$^3$).

In U.S. Pat. No. 3,938,440 propellant charges are disclosed wherein the weight of the propellant charge which can be packed into a given volume is increased by providing a mixture of granular propellant and molded bodies of propellant.

At the walls of the cartridge the packing is normally even more loose and the packing density in the wall region can consequently be even lower. In particular for large grains (for instance with 19 or 37 perforations) and/or for ammunition for small calibers, this wall-effect is more pronounced. As a result the packing density may be lowered by up to a further 10 vol. %.

The term packing density, as used herein, refers to the fraction of a certain volume that is used up by the solid grains. It is the opposite of the bed voidage, which term is commonly used to quantify the fraction of voids in a certain volume. In other words, packing density=100 vol. %-(bed voidage).

The grains used in the present invention have a cross-sectional shape that is non-circular and preferably elongated. Preferably the grain shapes are flattened or oblate so that the propellant grains have outer shapes that roughly approach an oblate spheroid, although they still may have edges that are optionally rounded.

It was found that particles of the present invention will increase the packing density, resulting in a higher charge density. The packing density in accordance with the present invention may be increased by 5 to 10%, or even more as compared to propellant charges using conventional grains. An increase in packing density from 52 to 55 vol. %, for instance, will result in a 6% higher charge density, which may lead, as a consequence, to an increase in kinetic energy of up to 12%.

The dimensions (largest dimension, e.g. length or diameter) of the grains are preferably between 1 and 40 mm, more preferably between 3 and 30 mm.

The websize is preferably between 0.1 and 5 mm, more preferably between 0.3 and 2.5 mm.

The optimal dimensions of the grains depend inter alia on the caliber for which it is used (e.g. medium caliber 20-about 76 mm or large caliber more than about 76 mm).

The length of the grains is typically between 0.8 to 4 times the diameter (or the equivalent diameter; the equivalent diameter is the diameter of a circle that has the same surface area), preferably between 1 tot 2.5 times. For instance, conventional grains having 19 perforations typically have a length that is 1-1.5 times the equivalent diameter, while conventional grains having 7 perforations typically have a length that is about 2 times the equivalent diameter.

The websize is the shortest distance between two opposite outer surfaces of a grain. For spherical and tubular grains this is approximately equal to the diameter. For strip or flake shaped grains this is the thickness of the strip or flake. For perforated grains this is the smallest distance between two perforations or between a perforation and the outer surface. Preferably the websize is the same throughout the grain.

The progressive burning of the grains of the present invention is preferably realized by providing perforations passing through the grains in the length direction. The perforations are preferably positioned in the pattern of an equilateral triangle because such a pattern minimizes the formation of sliver when the perforations merge at the end of the burning process.

Each perforation typically meets the following requirements. The dimension of the perforations in the grain must be large enough for the flame front to be able to penetrate throughout the whole channel and take use of the surface area during the burning cycle of the propellant, but not too big in order to prevent excessive empty volume and therefore lower bulk density. Typically the diameters of the perforations are between 0.01 to 1.5 mm, preferably between 0.05 to 0.8 mm. For most applications the diameters of the perforations are of similar size, but for certain applications different diameters might be used on purpose on the same grain.

Each perforation preferably has a cylindrical cross section. The diameter of each perforation is preferably about 0.5-10% of the length of the perforation, more preferably 1-4% of the length of the perforation. Merging of the perforations in the course of the burning process should be postponed as long as possible. Typically the perforations do not merge before 60-90 wt. % of the propellant is burned. This may be obtained by selecting the grain shape and position and number of perforations therein, in particular by selecting a pattern based on a hexagonal distribution (resulting in the pattern of an equilateral triangle, mentioned above).

Figure 2:
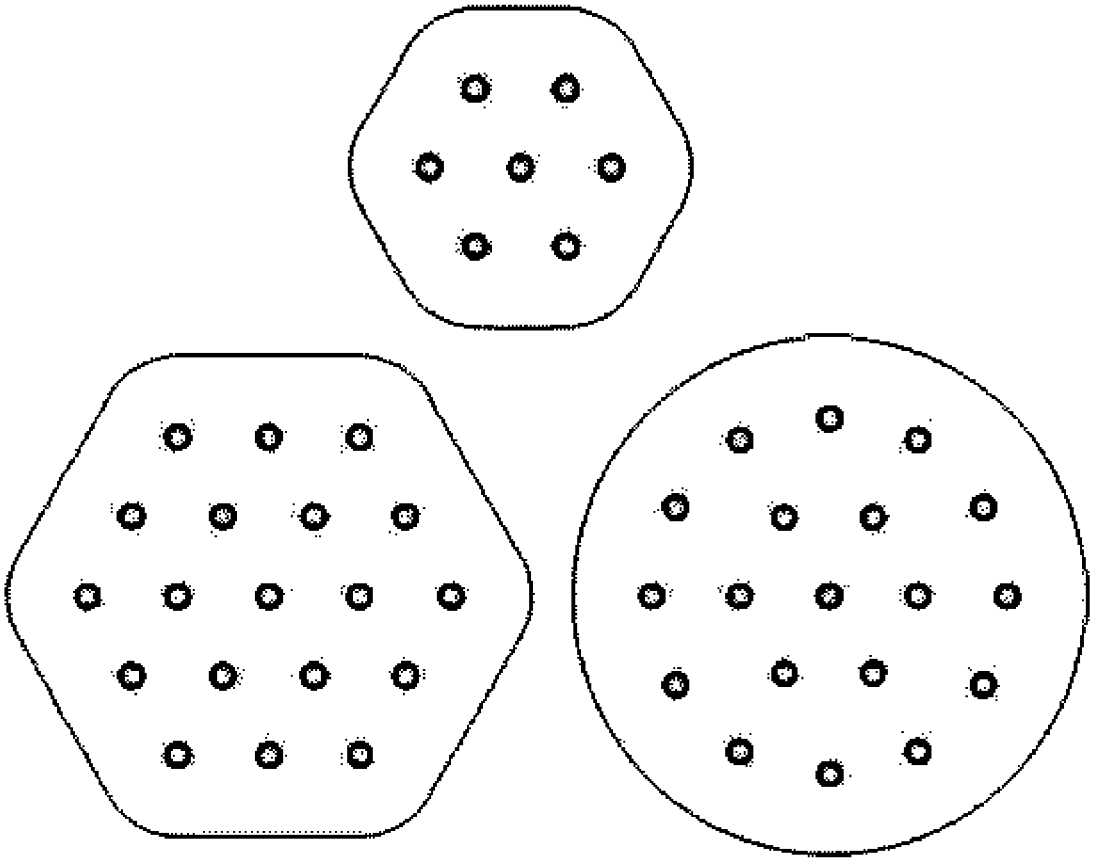
FIG. 2 is a schematic illustration of propellant grains having 7 and 19 perforation geometries.
Figure 3:
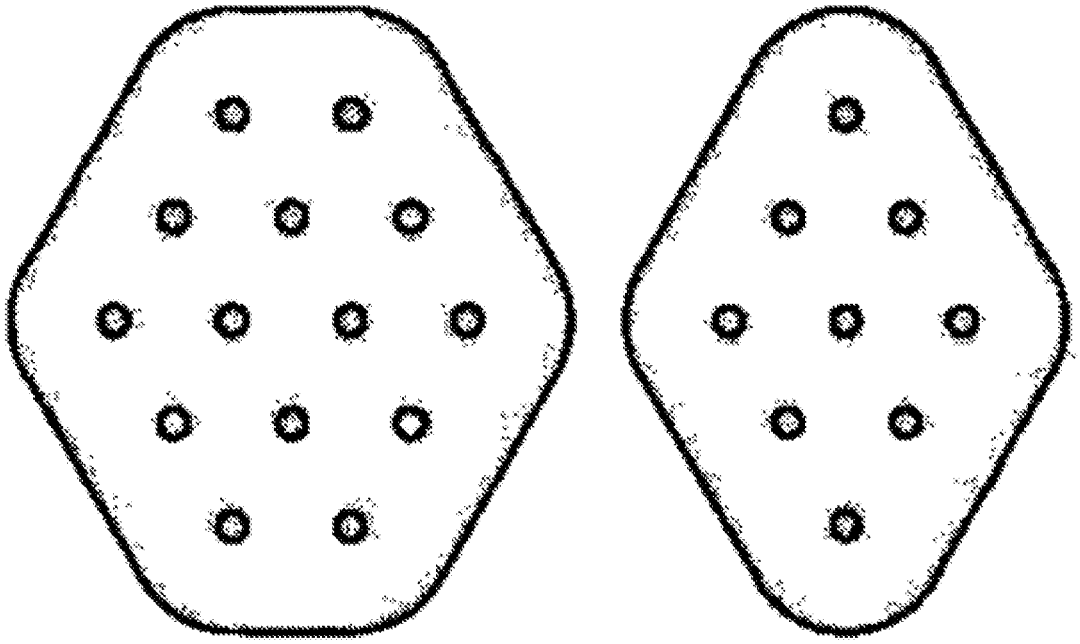
FIG. 3 is a schematic illustration of propellant grains having 14 perforation and 9 perforation geometries.

Higher progressivity may be obtained by applying more perforations thus decreasing the total surface area of a certain mass of propellant grains. In practice 14-perforation and 9-perforation geometries are particularly preferred, and are schematically depicted in FIG. 3, showing a cross section of such grains. These shapes may be considered a "geometrical interpolation" between conventional hexagonal 7—perforation and 19—perforation grain shapes, as shown in FIG. 2. Other possible configurations in accordance with the present invention are shown in FIG. 6.

Figure 6:
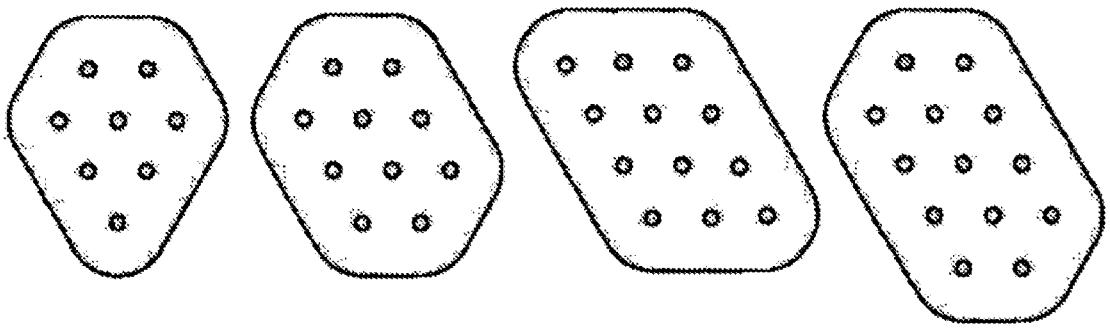
FIG. 6 is a schematic illustration of propellant grains in accordance with the invention wherein the first grain has a diamond shaped cross-section having five edges, the third grain having four edges, the second and fourth shapes having polygon shaped cross-sections with six edges, with four edges having the same length so that the polygon is elongated.

In FIG. 6, two diamond shaped cross-sections having five edges (first shape) or four edges (third shape) are depicted, as well as two polygon shaped cross-sections (second and fourth shape) having six edges, of which precisely four edges have the same length (such that the polygon is elongated).

Figure 7:
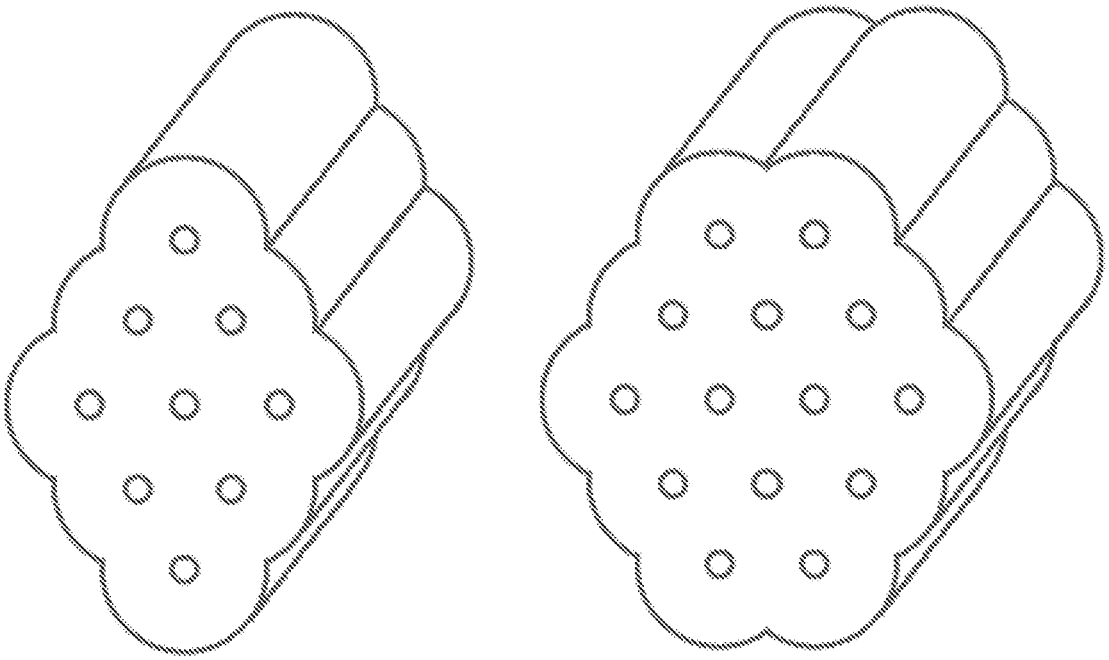
FIG. 7 is a schematic illustration of grains having a rosette shape.

The grains may either have flat longitudinal sides or sides that are curved around the outer perforations, thus resulting in a so-called "rosette" shape as depicted in FIG. 7.

Figure 4:
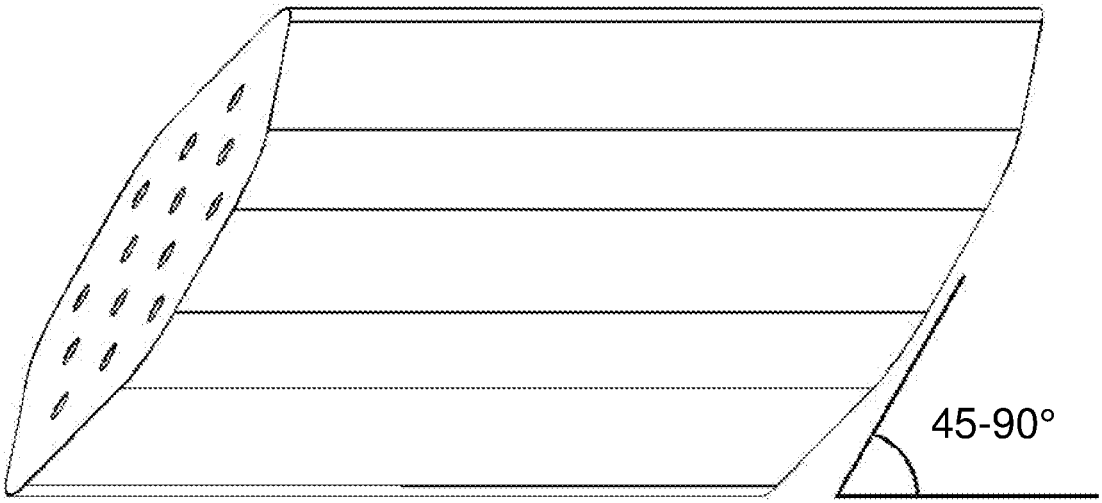
FIG. 4 is a schematic illustration of a grain formed by extrusion and having a cut with an angle relative to the longitudinal axis of the grain.
Figure 5:
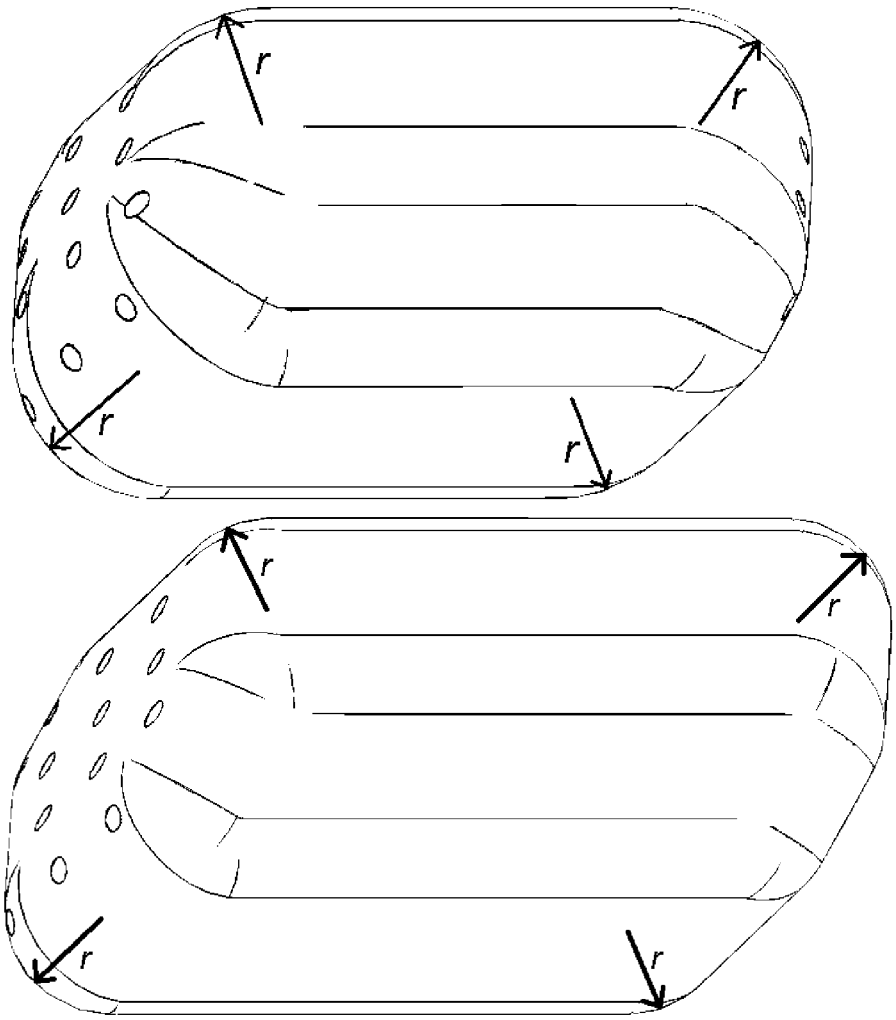
FIG. 5 is a schematic illustration of grains having rounded corners.

The grains of the present invention can be produced by extrusion. Extruded strands can be cut in different angles relative to the longitudinal axis of the strands. In order to let the grain shape approach spheroids in all directions, the cuts can be made under an angle of 45°-90°, preferably from 50-80°, more preferably about 60°, with respect to their longitudinal axis. This is schematically shown in FIG. 4. This contributes to a higher charge density, although possibly at the expense of a slightly lower progressivity. Further reduction of sliver and/or even higher packing is obtained when one ore more (preferably all) corners are further rounded, preferably with a radius of curvature that minimizes sliver, viz. that is one to three times the distance of two closest perforations in the cross sectional view. As schematically depicted in FIG. 5, for this embodiment the edges of a grain are rounded in the form of a sphere having a radius of curvature r.

The propellant grains of the present invention can be used in any ballistic application, but are especially beneficial when used with medium or large caliber ammunition.

In a further preferred embodiment of the present invention, the grains are provided with an outer layer that has a chemical composition that is less energetic than the inner composition, which results in an increase of the burn rate and of the flame temperature during the course of the propellant combustion process. This contributes to the progressivity of the propellant combustion. This variation in chemical composition throughout the propellant grain is conventionally achieved by impregnating the outer surface of the propellant with a substance that decreases the burning rate. This is particularly suitable for small and medium caliber propellants because the impregnation depth is generally too small to be effective for large caliber propellants, which have relatively large websizes. Impregnation can be done by using one or more substances like campher, dinitrotoluene, dibutylphthalate, dioctylphthalate, and other plasticizers or non-energetic polymers or monomers that are polymerized after impregnation in the outer propellant layers.

Another method to achieve the abovementioned variation in chemical composition is the application of a gradient of energetic propellant components, either in concentrations and/or in particle sizes, or the application of layers of different propellant compositions. This is particularly suitable for medium and large caliber propellants. A suitable manufacturing technique for producing the grains of the present invention comprising layers of different propellant compositions is co-extrusion.

The present invention will now be illustrated by the following examples.

EXAMPLES

Example 1

A solvent free gun propellant composition, comprising 50 to 60 wt. % nitrocellulose and 40 to 50 wt. % of plasticizers like nitroglycerine and diethylene glycol dinitrate as the main constituents was pressed through a cylindrical die with 19 pins as depicted in FIG. 2. The propellant burning rate and the die dimensions were such that the propellant combustion properties were suited for use in ammunition for 120 mm tank weapons. The diameter of the obtained propellant grains was 11.5 mm and the propellant grains were cut at a length equal to the diameter. The bulk density of the propellant grains was determined by pouring the grains in a cylinder of 0.5 litre volume and a diameter of 81 mm and measuring the mass of the propellant. The bulk density appeared to be 0.81 kg/dm$^3$.

Example 2

The same propellant composition as mentioned in Example 1 was pressed through dies with 9 pins with a cross sectional shape as depicted in FIG. 3. The obtained propellant strands, laying on one of the flat strand sides, were cut using a straight knife at an angle of 60° with respect to the longitudinal direction of the strands at a length of approximately 1.5 to 2 times the distance between two opposite flat strand sides. The obtained propellant grains were used to determine the bulk density using the same cylinder and procedure as mentioned in Example 1. The bulk density appeared to be 0.85 kg/dm$^3$.

Example 3

The same propellant composition as mentioned in Example 1 was pressed through a die with 14 pins of 0.5 mm diameter with a cross sectional shape as depicted in FIG. 3. The obtained propellant strands, laying on one of the flat strand sides, were cut using a straight knife at an angle of 60° with respect to the longitudinal direction of the strands at a length of approximately 1.5 to 2 times the distance between two opposite flat strand sides. The obtained propellant grains were used to determine the bulk density using the same cylinder and procedure as mentioned in Example 1. The bulk density appeared to be 0.88 kg/dm$^3$.

Example 4

Grains with an outer shape as depicted in FIG. 5 without perforations were made by a certain additive manufacturing (3D-printing) technique. The length and outer diameter of the grains was approximately equal to the propellant grains described in Example 3. All corners of the grains were rounded with a radius equal to two times the shortest distance between two perforations. The bulk density of the molded bodies was determined using the same cylinder and procedure as mentioned in Example 1. The obtained bulk density was converted to the bulk density of propellant grains with the same composition as those described in Example 1, with the same outer shape as the molded bodies, and having 14 perforations with a diameter of 0.5 mm. The converted bulk density appeared to be 0.96 kg/dm$^3$.

The invention claimed is:

1. Propellant charge comprising one or more longitudinally extending, progressive-externally burning grains having a number of perforations passing through the grains in the length direction, wherein said grains have a cross-sectional shape (perpendicular to the grain's length direction) that is elongated, wherein said grains have a cross-sectional shape that is line-symmetric in at most two different lines, and wherein said grains are cut under an angle of 45°-90°, relative to their longitudinal axis.

2. Propellant charge according to claim 1, wherein said grains comprise eight or more perforations.

3. Propellant charge according to claim 1, wherein said grains have a cross-sectional shape that is diamond shaped having four or five edges, or an elongated polygon having six edges, of which four have the same length.

4. Propellant charge according to claim 1, wherein said grains are made by extrusion.

5. Propellant charge according to claim 1, wherein at least part of said grains are provided with an outer layer that has a chemical composition that is less energetic than the inner composition of the respective grain.

6. Ammunition comprising a propellant charge according to claim 1.

7. Propellant charge according to claim 2, wherein said grains comprise less than eighteen perforations.

8. Propellant charge according to claim 7, wherein said grains comprise fourteen perforations.

9. Propellant charge according to claim 8, wherein said grains comprise nine perforations.

10. Propellant charge according to claim 1, wherein said grains are cut under an angle of about 60°, relative to their longitudinal axis.

* * * * *